United States Patent [19]

Pick

[11] Patent Number: 4,978,372

[45] Date of Patent: Dec. 18, 1990

[54] PLEATED CHARGED MEDIA AIR FILTER

[76] Inventor: William Pick, R.R. #1, Carleton Place, Ontario, Canada, K7C 3P1

[21] Appl. No.: 321,397

[22] Filed: Mar. 10, 1989

[30] Foreign Application Priority Data

Mar. 11, 1988 [CA] Canada ..... 561231

[51] Int. Cl.[5] ..... B03C 3/00

[52] U.S. Cl. ..... 55/132; 55/155; 55/146

[58] Field of Search ..... 55/131, 155, 132, 146

[56] References Cited

U.S. PATENT DOCUMENTS

| | | | |
|---|---|---|---|
| 2,067,822 | 1/1937 | Biederman | 55/131 |
| 2,297,601 | 9/1942 | Williams | 55/132 |
| 2,589,463 | 3/1952 | Warburton | 55/131 |
| 3,073,094 | 1/1963 | Landgraf et al. | 55/131 |
| 3,438,180 | 4/1969 | Klouda | 55/126 |
| 3,509,696 | 5/1970 | Thompson | 55/131 |
| 3,763,633 | 10/1973 | Soltis | 55/484 |
| 4,549,887 | 10/1985 | Joannou | 55/131 |
| 4,853,005 | 8/1989 | Jaisinghani et al. | 55/132 |

FOREIGN PATENT DOCUMENTS 1175754 10/1984 Canada .

OTHER PUBLICATIONS

International Publication WO87/0274, dated 4/23/87.

*Primary Examiner*—Bernard Nozick

*Attorney, Agent, or Firm*—Foley & Lardner, Schwartz, Jeffery, Schwaab, Mack, Blumenthal & Evans

[57] ABSTRACT

An electrostatic air filtration system of the charged media type wherein contact between the filter media and the electrostatic charging media of the filter is minimized or eliminated to increase the efficiency of the filter. The fibrous filter media is either corrugated to minimize its contact with the charging media or separated from the charging media by nonconductive spacers. This dramatically increases the efficiency of the filter by reducing the voltage drop on the charged media caused by conduction across a filter medium in close contact with both a charged and a grounded medium.

10 Claims, 8 Drawing Sheets

PLEATED CHARGED MEDIA AIR FILTER

The present invention relates to electrostatic air filtration systems of the charged media type and in particular to a novel construction for charged media type air filters wherein contact between the fibrous filter pads and the charging media of the filter is minimized or eliminated, resulting in a dramatic increase in the efficiency of the filter. A number of air filter constructions are disclosed which are adaptable to use as disposable cartridge type filters, as well as a novel air filter cartridge frame and a desk top air filter unit.

BACKGROUND OF THE INVENTION

Electrostatic air filtration systems of the charged media type are well known. Traditionally, these systems comprise a metallic screen charged with a high voltage/low amperage current which is sandwiched between a pair of fibrous filter pads and a pair of grounded metallic screens that cover each side of the filter sandwich. U.S. Pat. No. 4,549,887 and Canadian Pat. No. 1,175,754 describe charged media type air filters constructed in this fashion. Although these electrostatic air filters are much more efficient than passive air filtration systems, they have a feature in their design which can impair their efficiency. The close contact of the filter's charging screens with the fibrous filter pads can lead to a considerable voltage drop on the high voltage screen due to conduction across the filter media. This is especially true after the filter media has become soiled with dust and other airborne filtrates. A voltage drop of up to 60% of the input voltage has been observed on the charged screens of these filters. This voltage drop affects the strength of the electrostatic field created within the fibrous filter pads and thereby impairs the efficiency of the filter. The present invention overcomes this problem with a novel filter construction wherein contact between the fibrous filter media and at least one of the filter's charging screens is minimized or completely eliminated, enabling the maintenance of an electrostatic field of full or near full potential regardless of the contamination level of the filter media, thus providing an air filtration system of the charged media type which is dramatically more efficient than those of the prior art. It has also been established that an efficient filter can be produced with only two charging screens and a single filter pad, providing a more economical filter construction.

SUMMARY OF THE INVENTION

The present invention provides an electrostatic air filtration system of the charged media type comprising, in combination, electrically conductive charging media having passageways therethrough to allow for the substantially free passage of air, the charging media being in one or more pairs, the media of each pair located in opposed parallel spaced-apart relationship with a fibrous filter pad disposed between each adjacent pair of charging media. Conduction across the filter pads is reduced by either corrugating the filter pads or providing insulating spacers to separate each filter pad from one or both of the adjacent charging media. The charging media of the air filter are connected alternately to the respective poles of a high voltage power source to create an electrostatic field which polarizes the fibers of the filter media. An appropriately constructed frame supports the charging media, the filter media and the insulating spacers in the relation described within an air handling system.

DESCRIPTION OF THE DRAWINGS

The invention will now be described by way of example only and with reference to the following drawings wherein.

DETAILED DESCRIPTION OF THE INVENTION

Figure 1:
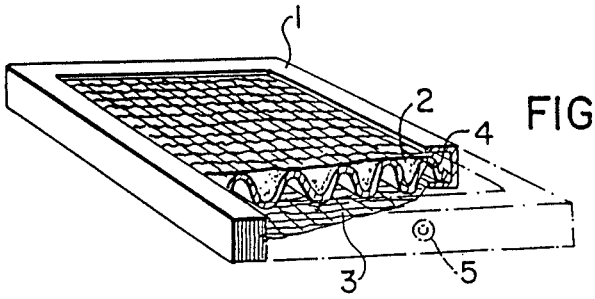
FIG. 1 is a perspective view of an air filter cartridge according to the invention with a portion cut away to show the corrugation of the filter media.

FIG. 1 illustrates a disposable filter cartridge according to the invention. The cartridge comprises an insulating frame 1 which houses a charging medium 2 on the top surface and a charging medium 3 on the bottom surface of the cartridge. Insulating frame 1 is preferably constructed of cardboard, although plastics or other non conductive materials are also suitable for this application. Charging media 2 and 3 are traditionally constructed of woven metallic screen, however, expanded metallic mesh has proven to be equally effective and more economical and any electrically conductive construction which provides for the free passage of air is suitable for the charging media. A corrugated fibrous filter pad 4 is disposed between the two charging media 2 and 3. Fibrous filter pad 4 is traditionally constructed of fiberglass but most dielectric fibers, including synthetic fibers such as polyester and blends of synthetic and natural fibers such as polyester and cotton have also been established to be effective filter mediums. A high voltage power jack 5 (see FIG. 23 for details) provides a connection between a high voltage power source (not illustrated) and the charging media 2 and 3 of the cartridge. The supply of power to the charging media can, of course, be arranged in any number of alternate ways well known in the art. The generally accepted practice is that charging medium 2 is grounded and that charging medium 3 is connected to a high voltage power of the order of 6 to 10 KV.

Figure 2:
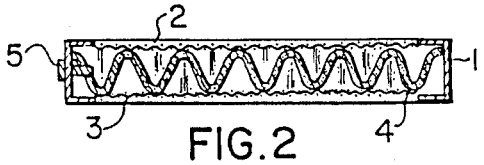
FIG. 2 is a cross sectional view of the filter cartridge of FIG. 1.

FIG. 2 shows a cross section of the filter cartridge of FIG. 1. The connection of charging media 2 and 3 with high voltage power jack 5 is also illustrated. It may be noted that high voltage medium 3 does not contact the cardboard frame 1 of the cartridge filter. This is to prevent arcing between the high voltage medium 3 and the frame 1 should the frame 1 become damp or soiled enough to become electrically conductive.

Figure 3:
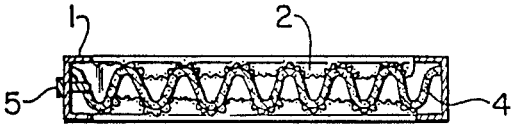
FIG. 3 is a cross sectional view of a variation of the filter cartridge of FIG. 1 wherein both the charging media and the filter media are corrugated to lend rigidity to the filter cartridge.

A variation of the filter cartridge of FIG. 2 is illustrated in FIG. 3. In this variation, the charging media 2 and 3 are latitudinally crimped to form partial corrugations which conform with the corrugations of the filter medium, lending rigidity to the filter cartridge. In this construction, the charging media are still adequately separated to significantly reduce conduction across a soiled filter pad while providing a more rugged replacement filter cartridge. The disposable filter cartridges of FIGS. 1 and 3 are supported in an air handling system by the filter cartridge frame of FIG. 22, as will become apparent.

Figure 5:
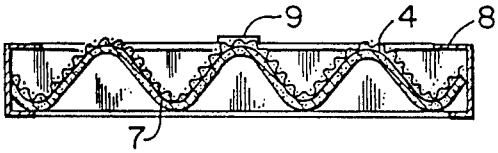
FIG. 5 is a cross sectional view of the filter cartridge of FIG. 4.
Figure 4:
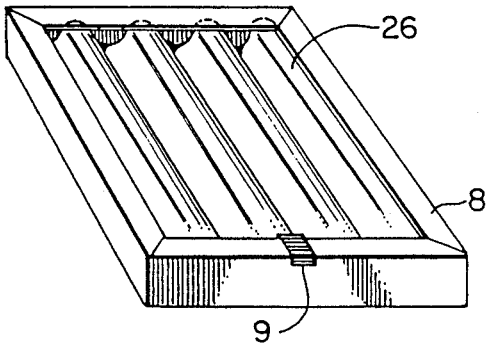
FIG. 4 is a perspective view of an alternate filter cartridge construction in accordance with the invention.

FIG. 4 and 5 show a novel construction for an efficient and very economical disposable filter cartridge. In FIG. 5 a single charging medium 6 and a single fibrous filter pad 7 are corrugated in unison and provided with a disposable frame 8. This disposable filter cartridge is supported in an air handling system by the filter cartridge frame shown in FIGS. 15 and 16, the construction and operation of which will be explained in detail hereinafter. Charging medium 6 serves as the grounded medium of the filter and is provided with a metallic foil ground connection 9, the function of which will also be explained hereinafter.

Figure 6:
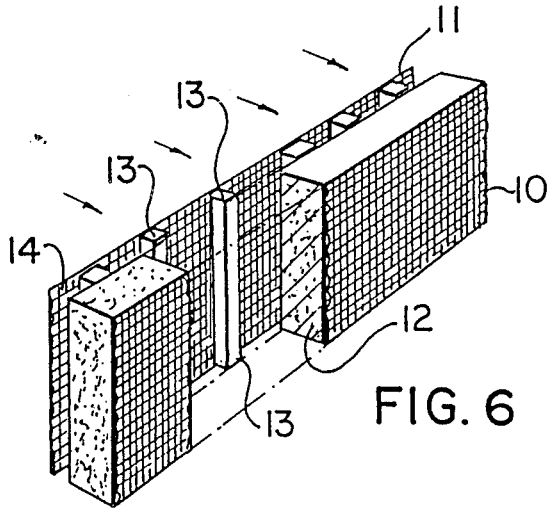
FIG. 6 is a perspective view of a filter construction according to the invention wherein a filter pad is disposed between two charging media and insulated from one of the charging mediums by insulating spacers.
Figure 7:
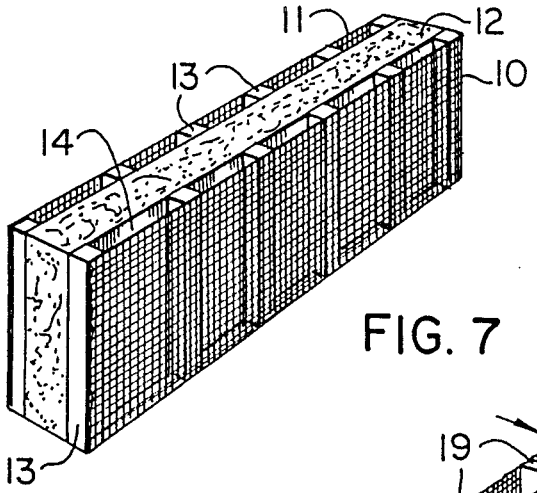
FIG. 7 shows a variation of the filter structure of FIG. 6 wherein the filter pad is insulated from both charging media.

FIGS. 6 and 7 illustrate two more disposable filter constructions according to the invention. In the construction shown in FIG. 6, charging media 10 and 11 are disposed on each side of a fibrous filter pad 12. Spacers 13 maintain an air space 14 between charging media 11 and filter pad 12. Air space 14 prevents electrical conduction across the filter pad and the resulting loss of potential in the filter's electrostatic field. The embodiment shown in FIG. 7 employs insulating spacers 13 between fibrous filter pad 12 and both charging media 10 and 11. These filter constructions may also be provided with cardboard frames, not illustrated for clarity, and power supply jacks such as the one shown in FIG. 23, or some alternate method known in the art of connecting the charging media to a high voltage power source. Filter cartridge constructions of this type are also supported in an air handling system by a filter cartridge frame such as the one shown in FIG. 22.

Figure 8:
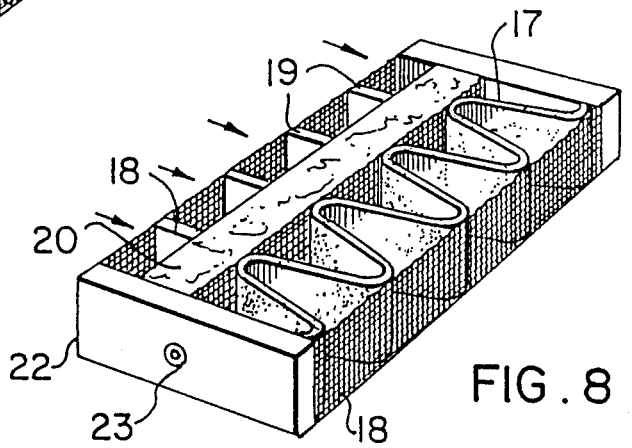
FIG. 8 is a perspective view of a filter construction wherein a corrugated and a flat filter pad are combined in a single filter cartridge structure in accordance with the invention.

Another embodiment of a filter structure is shown in FIG. 8 wherein a corrugated filter pad 21 and a flat filter pad 22 are used in combination to provide a progressive filter which is more efficient than the filters heretofore described. The upstream filter pad (either pad 21 or 22) is preferably of a coarser mat than the downstream filter pad, however, this is not mandatory. The central charging media 17 is traditionally connected to the high voltage pole of high voltage power supply jack 23 and the outside charging media 18 are traditionally connected to the neutral or grounded pole of the power supply jack 23 for security against shock. It has been established, however, that for purposes of functionality, connecting charging medium 18 to the high voltage power source and charging medium 17 to the neutral pole is equally effective. Spacers 19 separate charging medium 18 from flat filter pad 20 to prevent electrical discharge across the pad. Cardboard frame 20 is preferably continuous across the top and bottom of the filter cartridge but is shown cut away for clarity.

Figure 9:
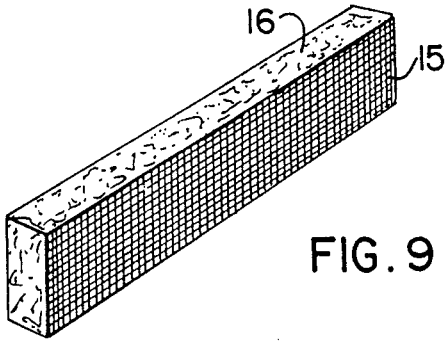
FIG. 9 is a perspective view of an economical filter cartridge wherein a charging medium is bonded to a filter pad.

In FIG. 9 an alternate economical filter cartridge construction is shown. This filter cartridge consists of a single charging medium 15 and a single fibrous filter pad 16. This filter cartridge construction is generally not provided with a cardboard frame. It may be supported in an air handling system by the filter cartridge frame illustrated in FIG. 15 or the desk top air filter unit illustrated in FIGS. 19 through 21. Charging medium 15 of this filter cartridge serves as the grounded medium of an air filter. When adapted for use with the filter cartridge frame of FIG. 15, charging medium 15 is made to project slightly beyond the edges of the filter pad 16 so that it contacts the edge of the grounded metallic frame 51 of cartridge filter support frame 50, as will be explained in reference to FIG. 15.

Figure 10:
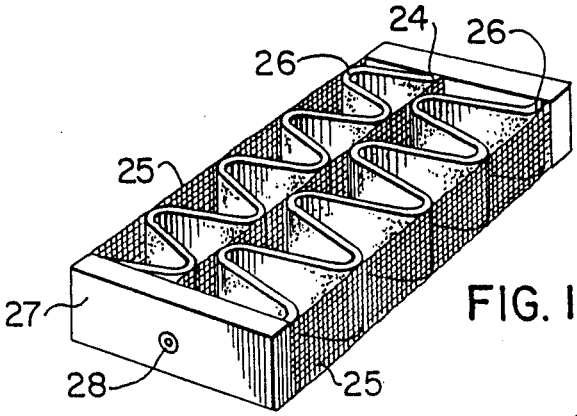
FIG. 10 is a perspective view of a filter construction wherein two corrugated filter pads are combined in a single filter cartridge structure.

FIG. 10 shows a further embodiment of a progressive filter cartridge similar to that shown in FIG. 8. In this embodiment, two corrugated filter pads 26 are disposed between a central charging medium 24 and two outside charging media 25. Again, the upstream filter pad is preferably a coarser mat than the downstream filter pad although this is optional. The two corrugated filter pads 26 provide more filtering surface and, therefore, less air pressure drop across the filter than occurs with flat filter pads. As in the embodiment in FIG. 8, the charging media are connected to the respective poles of high voltage power supply jack 28 in the manner described. Cardboard frame 27 is also preferably continuous across the top and bottom of the filter cartridge although it is only partially depicted for clarity.

Figure 11:
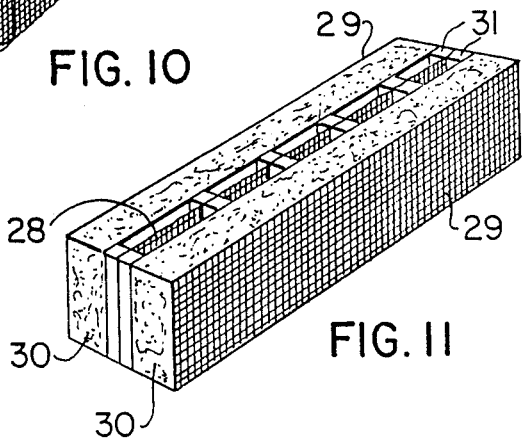
FIG. 11 shows a variation of the filter construction of FIG. 10 using two flat filter pads, each of which are separated from the central charging medium.

One further variation of the filter structures of FIGS. 9 and 10 is depicted in FIG. 11. In this embodiment of the invention, two flat fibrous filter pads 30 are disposed between two outside charging media 29. A central charging medium 28 is insulated from each filter pad 30 by opposing insulating spacers 31 to prevent electrical conduction across filter pads 30. A cardboard frame and high voltage power jack may also be provided in a manner previously described but are not illustrated for clarity. The filter cartridges shown in FIGS. 9, 10, and 11 are supported in an air handling system using a cartridge filter frame similar to the one depicted in FIG. 22.

Figure 12:
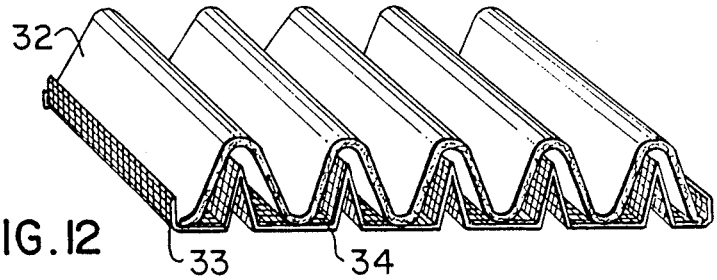
FIG. 12 is a schematic view of a filter cartridge of the invention in which the charging media is provided with latitudinal spikes which interleave the corrugations of a corrugated filter pad.
Figure 15:
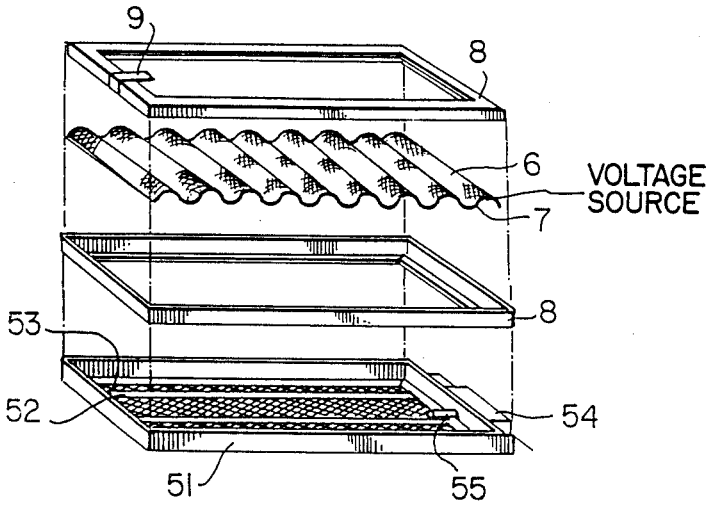
FIG. 15 is an expanded schematic view of a filter cartridge and a filter cartridge frame according to the invention.

FIG. 12 depicts a further embodiment of a disposable filter cartridge wherein a corrugated filter pad 32 is provided with a charging medium 33 which is constructed with latitudinal spikes 34 which interleave the corrugations of the filter pad 32. In this embodiment, the charging medium 33 serves as a frame for the disposable cartridge and filter pad 32 is bonded to the charging medium 33 with an appropriate adhesive. This disposable cartridge is used in conjunction with the disposable cartridge filter frame of FIG. 15. It is inserted into filter cartridge frame 50 in an orientation upside down to the illustration of FIG. 12 so that the fibrous filter pad 32 is adjacent the insulating spacers 52 of cartridge filter frame 50 (FIG. 15). Because of interleaved spikes 34 of the charging medium 33, an enhanced electrostatic field is created within and around corrugated filter pad 32, rendering this embodiment particularly useful where very fine airborne contaminants must be removed by an air handling system. The upturned ends of charging medium 33 contact the metal frame 51 of the cartridge filter frame 50 (see FIG. 15) when installed in the cartridge filter frame, providing grounding contact for the charging medium 33.

Figure 13:
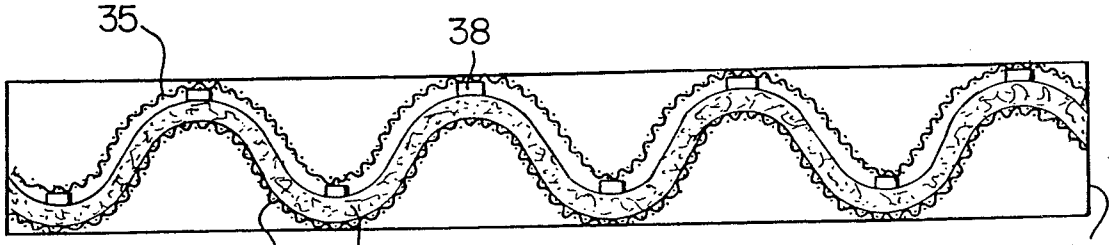
FIG. 13 is a cross sectional view of a filter cartridge according to the invention wherein insulating spacers maintain a corrugated charging media and a corrugated filter pad in a spaced relation.
Figure 14:
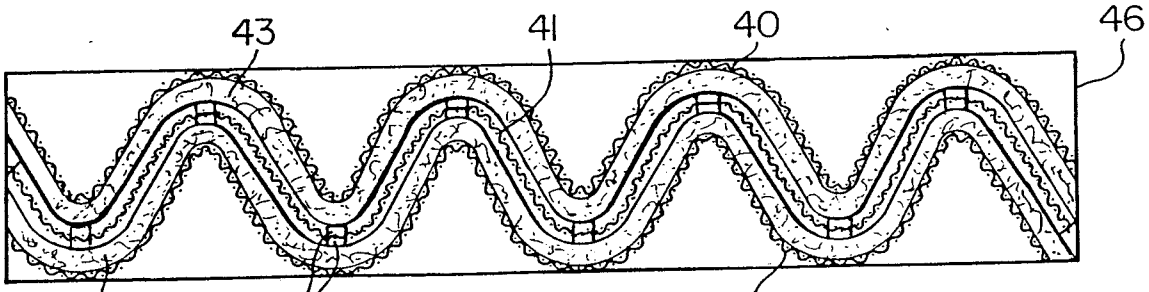
FIG. 14 is a cross sectional view of a variation of the filter cartridge of FIG. 13 wherein three charging media and two filter pads are combined to form a corrugated filter cartridge.

FIGS. 13 and 14 illsutrate further embodiments of filter structures according to the invention. The filter cartridge shown in cross section in FIG. 13 comprises two charging medium 35 and 36 and a fibrous filter pad 37. Filter pad 37 is separated from charging medium 35 by insulating spacers 38. Spacers 38 are affixed to the disposable cardboard frame 39 of the filter cartridge in the pattern illustrated to support the filter elements in the corrugated configuration shown. This structure provides an air filter with an increased surface area and, therefore, less air pressure drop across the filter than the traditional flat filter pads of the prior art. Charging medium 35 and 36 are connected to a high voltage power source in any order in a manner already described and well known in the art.

In FIG. 14, a similar disposable filter cartridge structure is shown which provides either a graduated filter or a double filter of the corrugated type. The outside surfaces of the corrugated filter pads are covered by charging medium 40 and 41 and a central charging medium 42 is also provided. Two fibrous filter pads 43 and 44 are disposed on either side of the central charging medium 42 and separated therefrom by opposing pairs of insulating spacers 45. Spacers 45 are attached to the cardboard filter cartridge frame 46 in the pattern illustrated to support the filter elements in the corrugated relation shown. The upstream filter pad, 43 or 44, is preferably of a coarser mat than the downstream filter pad, however, this is optional. Filter cartridge frame 46 is provided with a high voltage power jack 47 and connected to the charging medium as illustrated, the central charging medium 42 being preferably connected to the high voltage pole of power jack 47 for reasons of security against shock. The filter cartridge shown in FIGS. 13 and 14 are supported in an air handling system using a filter cartridge frame similar to the frame of FIG. 22.

FIG. 15 shows a filter cartridge support frame according to the invention and an expanded view of the filter cartridge of FIGS. 4 and 5. Filter cartridge support frame 50 comprises a metallic frame 51, a charging medium 53 attached to but insulated from frame 51 in a manner known in the art, for example, a slotted plastic member **51*a* is supported by frame 51 and in turn supports changing medium 53, the connections being made by staple fasteners 90, and insulating spacers 52 disposed at intervals across the surface of the charging medium 53. A high voltage power supply is housed in box 54A which is attached to one end of the frame 51 in this embodiment. The high voltage pole of the power supply 54 (see FIG. 16) is connected via insulated electrode 55 to charging medium 53. The neutral pole of the power supply 54 is connected to metallic frame 51. In use, power supply 54 is connected to an electrical power source and the charging medium 53 is thereby charged with a high voltage/low amperage direct current of the order of 6 to 10 KV. The charging voltage is preset depending on the type of cartridge to be used with filter cartridge frame 50. In general, the thicker the filter pad of a cartridge, and consequently the more distanced the charging medium 53 on the bottom of the filter cartridge support frame 50 and the charging medium 6 of the filter cartridge, the higher the voltage required on charging medium 53**.

Figure 16:
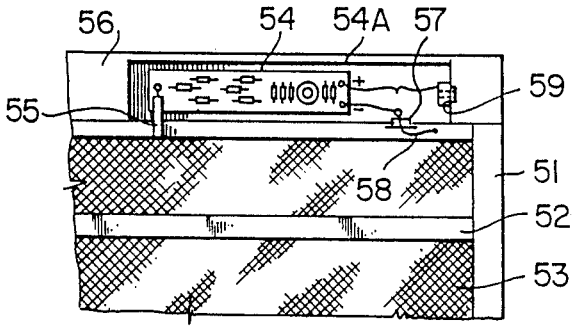
FIG. 16 is a plan view of a corner section of the filter cartridge frame of FIG. 15 showing the details of the high voltage power supply and a switch mechanism for deenergizing the high voltage charging media when a filter cartridge is removed from the frame.
Figure 17:
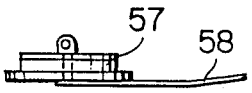
FIG. 17 is a side view and a plan view of the switch mechanism for the filter cartridge frame of FIG. 16.
Figure 18:
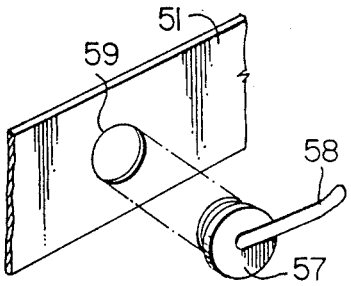
FIG. 18 is a perspective view of the switch mechanism of FIG. 16 and a portion of a filter frame provided with a hole for mounting the switch.

FIG. 16 shows in detail a portion of the cartridge filter support frame of FIG. 15, illustrating the construction of the power supply 54 and an optional media charging power interrupter switch 58. Power supply 54 is shielded in a protective box 54A which is supported by a projecting lip 56 which extends from a lower edge of frame 51. Box 54A is provided with an electrical power supply jack 59. The positive pole of jack 59 is connected to the positive input pole of power supply 54. The neutral pole of the jack 59 is connected to frame 51 or box 54A which is electrically continuous with the frame 51. The neutral pole of power supply 54 is connected to the connector end of a resilient switch member 58. Switch member 58 is retained in a hole 59 in frame 51 by a frictionally engaging mounting 57 (FIGS. 17 and 18). Switch 58 is insulated from mounting 57. In use, when an appropriately sized filter cartridge is inserted into frame 51, the cardboard frame 8 of the filter cartridge (see FIG. 15) forces the resilient switch 58 into contact with the metallic frame member 51 of the cartridge filter support frame 50, completing the power supply circuit and providing high voltage power flow through electrode 55 to the charging media 53. Referring again to FIG. 15, grounding connector 9 on the cardboard filter frame 8 contacts filter frame 51, grounding charging media 6 and completing the circuitry required to create an electrostatic field in an around the filter pad 7. Switch 58 is optional and is not installed if a soft sided filter cartridge such as the filter cartridge of FIG. 9 is to be used in filter cartridge support frame 50.

Figure 19A:
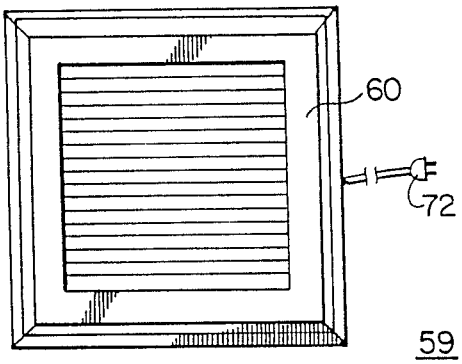
FIG. 19A is a plan view of a desk top filter unit according to the invention.
Figure 19B:
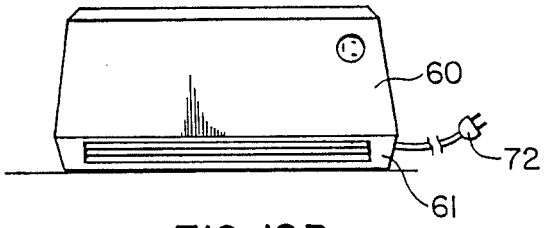
FIG. 19B is a side view of the desk top filter of FIG. 19A.
Figure 19C:
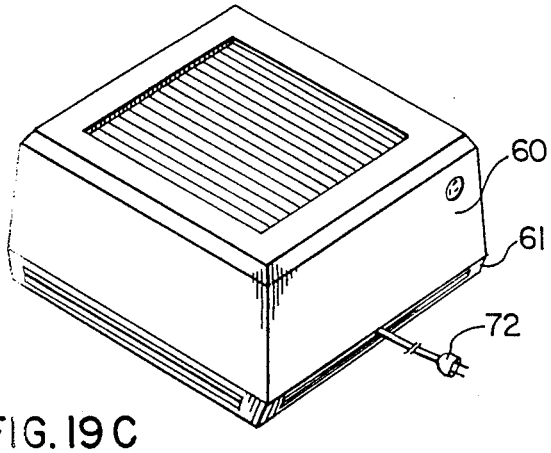
FIG. 19C is a perspective view of the desk top filter unit of FIG. 19A.
Figure 20:
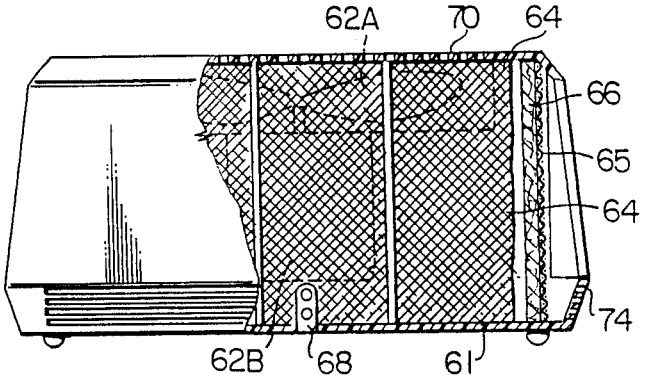
FIG. 20 is a side view of the desk top filter unit of FIG. 19, a portion of the filter unit housing being cut away to illustrate the construction of the unit.
Figure 21:
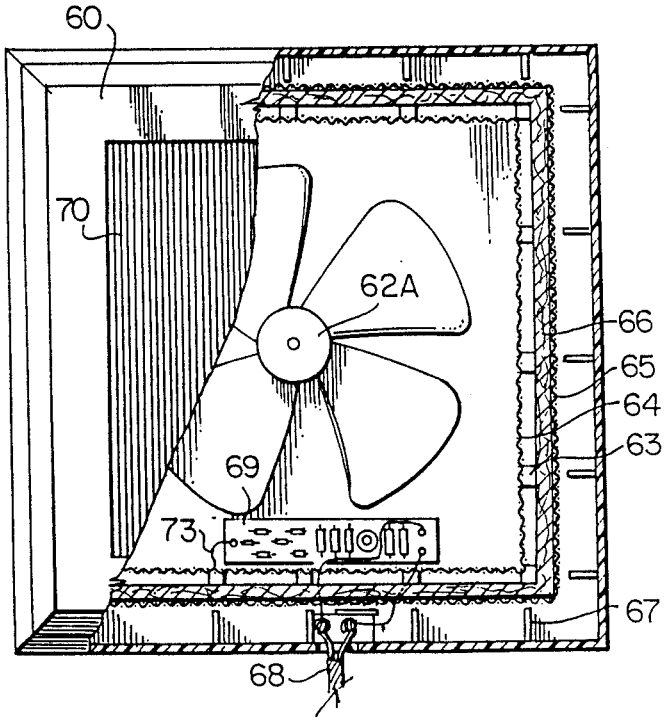
FIG. 21 is a plan view of the desk top filter unit of FIG. 19, a portion of the filter unit housing being cut away to illustrate the construction of the unit.

FIG. 19 shows a novel desk top air filter unit, generally referred to by reference 59, in accordance with the invention. A two part housing with a top part 60 and a base part 61 encloses the other functional parts of the unit. A standard power cord 72 supplies AC power to the unit. Referring now to FIGS. 20 and 21, housings 60 and 61 are provided with louvres 70 and 71 respectively to permit the passage of air through the filter unit. A fan 62A is driven by a motor 62B which is powered by electric power cord 72. Air forced through the filter by fan 62A must pass through the electronic filter structure which comprises an inside high voltage charging medium 64 that is supported away from filter pad 66 by upright insulating supports 63. The grounded charging medium 65 is bonded to the filter pad 66 to form a disposable filter cartridge of the type shown in FIG. 9. Fins 67 which project from the inside surface of the housing part 60 serve to retain the cartridge filter formed by filter pad 66 and charging medium 65 in close proximity with upright supports 63 and charging medium 64. Grounded charging medium 65 contacts a grounding shoe 68 which is attached to the neutral line of power cord 72. High voltage power supply 69 is attached to the positive line of power cord 72. The high voltage power supply provides a high voltage current of the order of 6 to 10 KV to charging medium 64 which polarizes the fibers of the filter pad 66 and any particles in the air forced through the filter pad by fan 62A. The polarized air contaminants are thereby strongly attracted to the fibers of the filter pad and most of the contaminants cling to the pad even though they are small enough to pass through the pad without obstruction. When the desk top air filter unit requires servicing, power cord 72 is unplugged, and the upper housing part 60 is removed to expose the interior of the unit. The disposable filter cartridge which comprises charging medium 65 and filter pad 66 bonded together as a unit is removed and a fresh filter cartridge is inserted. Once the filter cartridge is replaced with a fresh cartridge, the upper housing part 60 is replaced and the unit is again ready for use.

Figure 22:
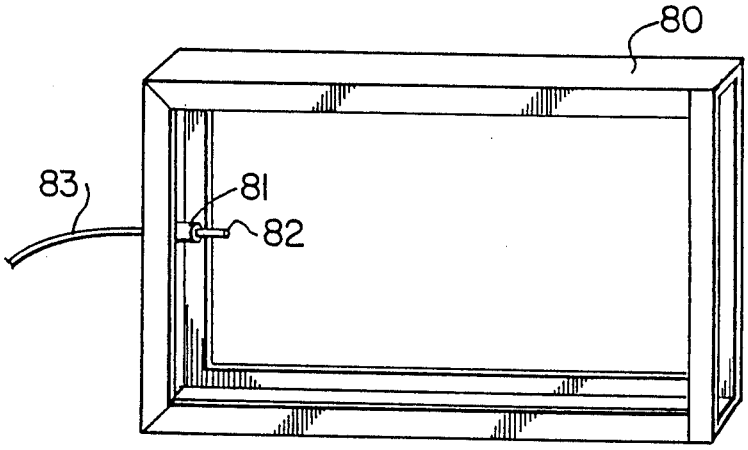
FIG. 22 is a perspective view of a prior art filter cartridge frame suitable for use with certain of the filter cartridges of the invention.
Figure 23:
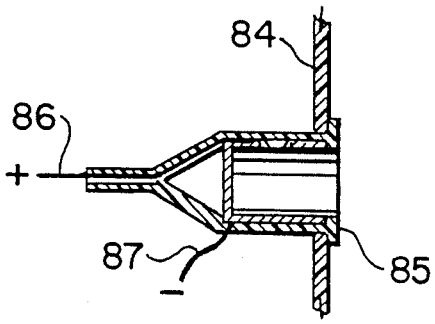
FIG. 23 is a perspective view of a prior art high voltage power supply jack suitable for use with certain filter cartridges of the invention.

FIGS. 22 and 23 illustrate prior art devices used in conjunction with certain filter cartridge structures heretofore described. In FIG. 22 a filter cartridge support frame 80 is provided with a composite electrode which has a neutral pole 81 and a high voltage pole 82. Power is supplied to the high voltage electrode by a high voltage supply cable 83. FIG. 22 illustrates a cross sectional view of a high voltage power jack which is mounted on the filter cartridges so as to engage the high voltage electrode of the filter support frame 80 of FIG. 22 when the cartridges are inserted into the support frame. High voltage jack 85 is mounted in an end of a cardboard filter cartridge frame 84 and connected via positive lead 86 and negative lead 87 (see FIG. 23) to the charging media of the filter cartridge as required by the construction of the filter cartridge.

I claim:

1. In an air filtration system of the charged media type, the combination of:

electrically conductive charging media having passageways therethrough to allow for the substantially free passage of air, said charging media being in one or more pairs with the media of each pair complementarily corrugated and located in opposed spaced-apart relationship;

a filter medium comprising a fibrous filter pad complementarily corrugated with said charging media and disposed between the media of each said pair of charging media;

electrically insulating spacers separating said filter pad from at least one of said charging media adjacent said filter pad;

means for connecting the charging media of each said pair to respective poles of a high voltage power supply; and frame means for supporting said charging media, said filter media and said insulating spacers in their aforesaid relationship with one another within said air filtration system.

2. A frame for supporting a disposable air filter cartridge in a passageway for air to be filtered in an air filtration system, comprising:

a shallow rectangular tray having an electrically conductive bottom part and provided with passageways therethrough to permit the substantially free passage of air, the tray further provided on its inside surface with electrically insulative spacers in spaced-apart relationship with each other and positioned to prevent the cartridge from coming into electrical contact with the bottom part of the tray, the spacers being electrically insulated from the sides of said tray; and a high voltage electrical power source providing a voltage across a dielectric filter element of the cartridge, the bottom of said tray connected to one pole of the high voltage power source and conductive screen of the cartridge remote from the tray connected to the other pole of the power source.

3. An air filter cartridge frame as in claim 2, comprising:

a shallow rectangular metal tray, having a bottom part comprising a metallic screen or expanded mesh insulated from the sides of said tray, said tray being further provided with a projecting lip along one side;

a high voltage power supply device affixed to said projecting lip of said tray and housed within a protective shield;

an electrical power supply jack for connecting said high voltage power supply device to an electrical power source, a positive pole of said jack being connected to a positive input pole of said high voltage power supply device and a neutral pole of said jack being connected to a neutral input pole of said high voltage power supply device and to a side of said tray;

electrical connection means provided between a high voltage output pole of said high voltage power supply device and the bottom part of said tray, said connection means being insulated from the sides of said tray.

4. An air filter cartridge frame as in claim 3, further comprising an electrical switch means comprising a resilient conductor means and a conductor mounting means, said conductor mounting means frictionally engaging a hole in a side of said tray, said conductor means being substantially L-shaped and insulated from said mounting means, said conductor means being connected on its one end to said neutral input pole of said high voltage power supply, its free end being normally parallel to and closely spaced from a side of said tray so that on insertion of a suitably sized filter cartridge into said tray, said free end of said conductor is forced into contact with said side of said tray and on removal of said filter cartridge, said conductor returns to its normally parallel, spaced relationship with said side of said tray.

5. In an air filtration system, an electrostatic air filter of the charged media type including a disposable air filter cartridge and a support for the disposable air filter cartridge in an air filtration system, comprising in combination;

at least one pair of electrically conductive charging media having passageways therethrough to permit the substantially free passage of air, the media of each said pair being in opposed parallel spaced apart relationship;

a dielectric filter pad disposed between the charging media of each said pair;

spacing means for minimizing the contact between said filter pad and at least one charging medium of each said pair so that electric discharge across said dielectric filter pad is thereby minimized;

means for connecting the charging media of each said pair to the respective poles of a high voltage power supply, one pole electrically connected to one charging medium and the other pole electrically connected to the other charging medium to create a voltage charge across the filter pad; and a frame for supporting said charging media and said filter pad in the aforesaid relationship within a passageway for air to be filtered in said air filtration system.

6. In an air filtration system, an electrostatic air filter of the charged media type as in claim 5 wherein said disposable air filter cartridge comprises;

a pair of charging media in parallel spaced apart relationship;

a dielectric filter pad disposed between said charging media;

electrically insulating spacers disposed between said filter pad and one said charging medium; and means for connecting said charging media to the respective poles of a high voltage power source.

7. In an air filtration system, an electrostatic air filter of the charged media type as in claim 5 wherein said disposable air filter cartridge comprises;

a pair of charging media in parallel spaced apart relationship;

a dielectric filter pad disposed between said charging media;

electrically insulating spacers separating said filter pad from each of said charging media;

means for connecting said charging media to the respective poles of a high voltage power source.

8. In an air filtration system, a disposable air filter cartridge as in claim 6, wherein said air filter cartridge further includes a supporting frame which surrounds the edges of said charging media and said filter pad.

9. In an air filtration system, an electrostatic air filter of the charged media type as in claim 5 wherein said disposable air filter cartridge comprises;

a charging medium and a dielectric filter pad having substantially the same dimensions and adhesively bonded together in opposed relationship.

10. In an air filtration system, an electrostatic air filter of the charged media type as in claim 5 wherein said disposable air filter cartridge comprises;

a charging medium and a dielectric filter pad having substantially the same dimensions and frictionally bonded together in opposed relationship.

* * * * *